United States Patent [19]

Warshaw et al.

[11] 4,182,223

[45] Jan. 8, 1980

[54] SWIVEL MOUNTING FOR TAPE APPLYING APPARATUS WIPE DOWN ROLLER

[76] Inventors: Saul Warshaw, R.D. No. 1, Box 227, Hawley, Pa. 18428; Winton S. Loveland, Fort Salonga, N.Y. 11754

[21] Appl. No.: 913,539

[22] Filed: Jun. 7, 1978

[51] Int. Cl.[2] ..... B31D 1/60

[52] U.S. Cl. ..... 93/36.9; 53/137; 156/468; 156/489

[58] Field of Search ..... 156/468, 489; 93/36.7, 93/36.9; 53/137

[56] References Cited

U.S. PATENT DOCUMENTS

| | | | |
|---|---|---|---|
| Re. 26,650 | 8/1969 | Loveland et al. | 53/75 |
| 3,236,716 | 2/1966 | Loveland et al. | 156/468 |
| 3,461,020 | 8/1969 | Loveland et al. | 156/468 |

*Primary Examiner*—Othell M. Simpson
*Assistant Examiner*—K. Y. Lin
*Attorney, Agent, or Firm*—Watson, Leavenworth, Kelton & Taggart

[57] ABSTRACT

A wipe down roller for use in apparatus for applying tape to cartons in which the roller is mounted to swivel to allow for uniform roller contact and pressure application to the tape when such roller is engaged by an end wall panel of the carton which is skewed relative to the longitudinal travel course the carton traverses while passing through the apparatus.

5 Claims, 8 Drawing Figures

SWIVEL MOUNTING FOR TAPE APPLYING APPARATUS WIPE DOWN ROLLER

BACKGROUND OF THE INVENTION

Various apparatus for sealing carton closures are known. In one type of apparatus, tape is applied to the top and/or the bottom panels of the carton to seal the closure flaps in closed condition, there additionally being sufficient tape applied to overlap the front and rear end wall panels, i.e., to extend up and down a distance on such end panels. When using apparatus such as that described in U.S. Pat. No. Re. 26,650, no difficulty is encountered in keeping the carton squared on the conveyor which transports the carton through the apparatus. Such apparatus has clamping guidance side rails as well as a flight conveyor which insures that the end wall panels of the carton are maintained in a disposition transversely perpendicular to the straight line travel course of the carton through the apparatus and thus can engage the transversely disposed wipe down rollers readily uniformly in a contact therewith extending the full length of the rollers. On the other hand, and in instances where no such carton or guidance means are employed in the apparatus and which can insure such squared carton condition during its travel through the apparatus, the carton received on the conveyor can be or becomes displaced from its squared position thereon such as to present a condition in which the end wall panels are skewed relative to the intended fixed travel course. As a consequence, the wipe down rollers which are generally transversely perpendicularly disposed to the travel course will engage only a part of the lateral expanse of the applied tape on such end wall panels and the remainder expanse will not be properly sealed against the carton and wall panels. This is undesirable as it produces improperly sealed cartons. It is also possible for a carton to have its square or rectangular profile distorted while it is in the taping apparatus. Thus, under certain circumstances and where side guidance rails are used, the pressure of the guidance rails can pinch the carton to deform it from a square or rectangular profile to one of a parallelagram in which the front and rear panels are skewed relative to the longitudinal travel course of the carton, even though the side walls of the carton are held parallel to and moved parallel with such travel course. The same problem of ineffective wipe down roller contact is thus encountered.

BRIEF DESCRIPTION OF THE INVENTION

The present invention is an improvement in the wipe down roller devices of the type disclosed in U.S. Pat. No. 3,236,716. In particular, it improves upon the manner of mounting the tape engaging wipe down members, i.e., the rollers to the scissored arm sets employed in such apparatus. In accordance with the present invention, the wipe down member that is the wipe down roller, is rotatably mounted at the end of its associated scissor arm thereby allowing the wipe down roller to swivel for maintaining it along its full length in substantially uniform conformable wipe down engagement with a carton end wall panel which is skewed relative to the fixed longitudinal course the carton is traversing through the apparatus, which skewed disposition is understood as being a panel positioning other than transversely perpendicular to said travel course. Thus when the skewed end panel comes into contact with the roller which has its roller member axis of rotation disposed normally perpendicularly transversely of the fixed travel course, the movement of the carton causes a swivelling of the roller to move it to a disposition parallel to the skewed panel and into firm wipe down contact with the tape applied to the end panel and thereby to cause it to exert a substantially uniform wipe down pressure along the full lateral expanse of the tape. Biasing means in the form of a blade spring is carried on the scissor arm and engages the wipe down member, such means tending to maintain the wipe down member disposed transversely perpendicular to the fixed course. However, the biasing force yields to the movement of the skewed end panel of the carton against the roller allowing for the desired proper wipe down action and after the carton passes beyond the roller, that is, when the roller moves into contact with either the top or bottom panel of the carton as the case may be depending on whether the roller is in an upper or a lower roller set, the biasing means returns the roller to its transversely perpendicular orientation.

In accordance with the invention, the roller is rotatably carried on a bracket which in turn is provided with a pintle, such pintle being received in a bored passage at the tip end of the scissor arm. A lateral projection carried on the pintle and extending into a slotted opening in the arm functions to limit the extent to which the wipe down member can be swivelled.

BRIEF DESCRIPTION OF THE DRAWINGS

The invention will appear more clearly from the following detailed description taken in conjunction with the accompanying drawings in which.

DESCRIPTION OF THE PREFERRED EMBODIMENTS

Commonly assigned U.S. Pat. No. 3,236,716 entitled "Tape Applying Mechanism" describes the operation of scissored wipe down arms and roller means of the type with which the present invention is concerned. As such patent shows, a tape engaging member 54 (rollers) are disposed at the outer edge of the scissored arms, which scissored arms are mounted on a common axis. The said patent describes the construction and operation of these wipe down arms in the same manner as which the said wipe down arms of the present invention function. Accordingly, the disclosure of that patent as to the construction and operation of the wipe down devices is incorporated herein with particular reference being made to FIGS. *6a–6c* which show the wipe down action of the rollers on successive ones of cartons passing through the machine. While the present invention is described and illustrated with respect to use of a lower set of wipe down arms only, it will be appreciated and understood that a second lower set could be used and upper roller sets be employed as well, such wipe down roller means being constructed and functioning in the manner as set forth in said-mentioned patent with the exception of the mounting of the roller members at the tip ends of the scissored arms for swivelling movement in the manner provided by the present invention.

Figure 1:
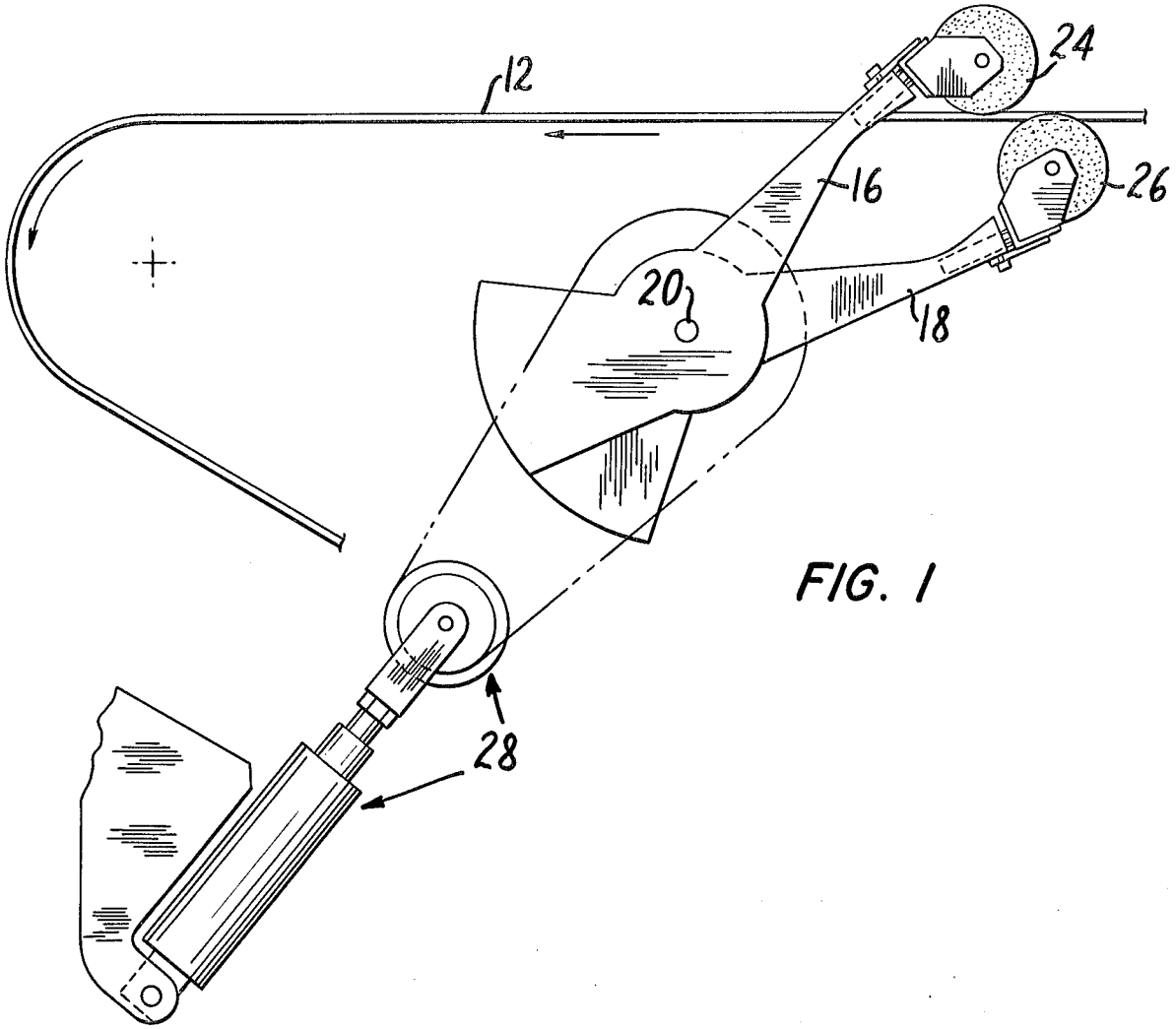
FIG. 1 is a fragmentary side elevational view, depicting the apparatus improvements of the present invention, only one lower set of tape wipe down rollers being depicted, it being understood that upper wipe down roller devices also can be employed and be provided with swivel mounted rollers in the same manner as the lower set.
Figure 2:
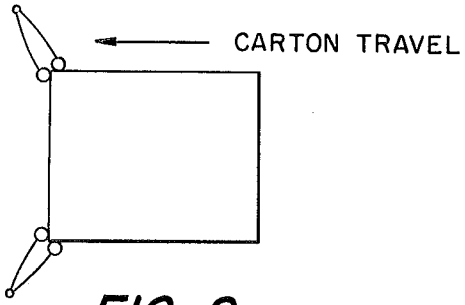
FIG. 2 is a diagrammatic depiction of the manner in which a carton travelling on the conveyor makes first wipe down roller engagement with upper and lower wipe down roller sets when the apparatus is so equipped.

Referring now to FIG. 1, there is depicted in fragmentary elevational view, the apparatus improvements of the present invention. The apparatus 10 includes a conveyor belt means provided as two side-by-side spaced belts 12, 14 (FIG. *5a*) which move from right to left in the drawing, a pair of scissored mounted arms 16, 18 fixed to a common pivot 20 disposed transversely perpendicularly of the fixed longitudinal travel course 22 (FIG. *5a*) in which the carton travels and each of which has rotatably mounted at the tip ends thereof, a respective wipe down roller 24, 26. There further is illustrated generally at 28, the means by which scissored arm movement is controlled during the course of passage of a carton through the apparatus and for further elucidation covering same, reference is made to U.S. Pat. No. 3,236,716. In the depicted embodiment it will be understood that the roller 24 is designed to engage the front end panel of the carton and to rotate counterclockwise up and down against the leading end panel of the carton and then to pass to the underside of said carton and wipe down tape at the bottom panel of the carton. The other roller 26 will be understood will effect wipe down of the bottom panel of the carton and as the carton passes beyond the first roller 24, the second roller 26 will move up against the rear or trailing end panel and wipe down tape overlapping such end panel. While only one lower set of wipe down rollers is depicted, it will be understood that a second lower set of such rollers could be employed and would be located upstream of the depicted set and that additionally, one or more pairs of upper roller sets could be employed in conjunction with the wiping down of tape at the tops of the end panels and the top panel of the carton itself. Where upper and lower sets are employed, the initial contact of the roller sets with the carton would be as depicted diagrammatically in FIG. 2.

Figure 3:
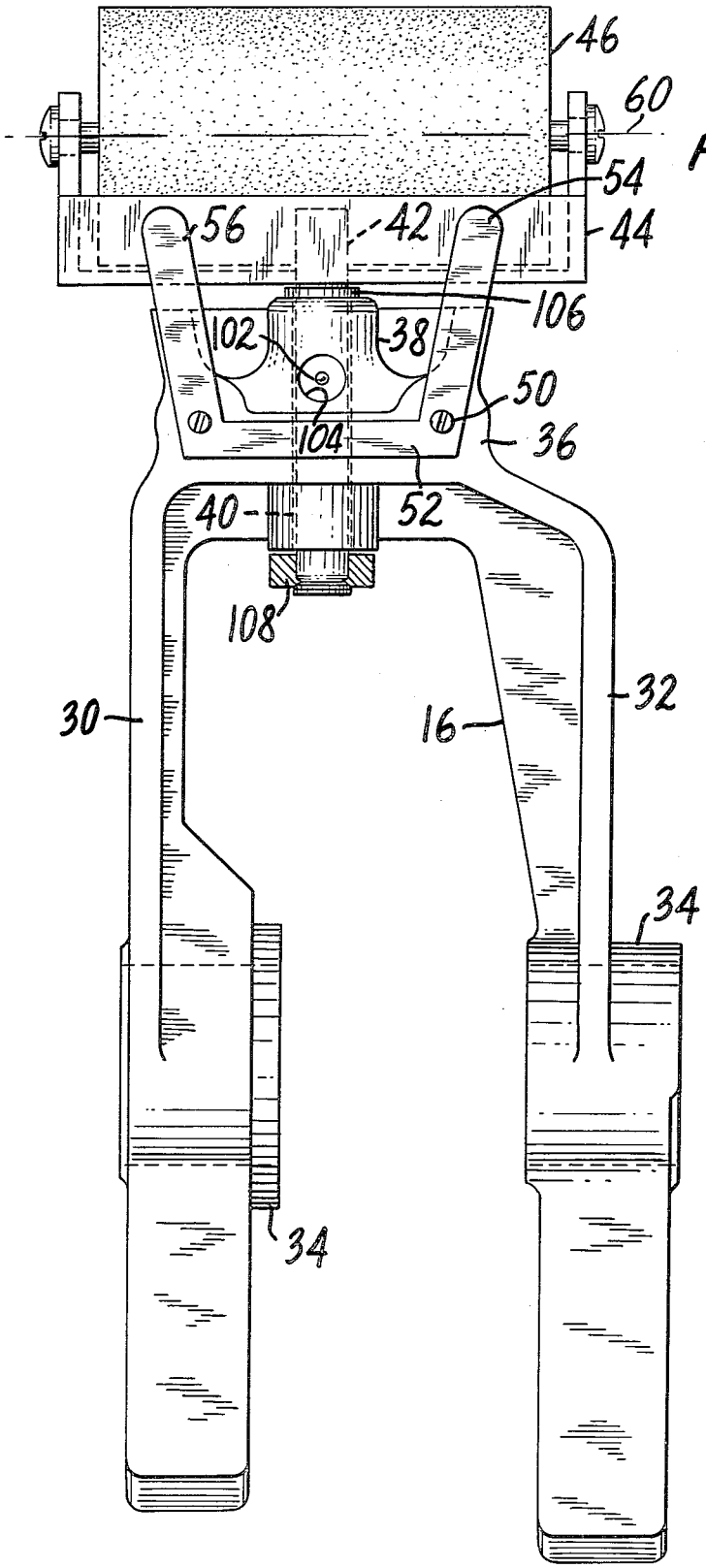
FIG. 3 is a front elevational view of one of the arms of the wipe down device shown in FIG. 1 and illustrating the swivel mounting of the wipe down roller thereon.
Figure 4:
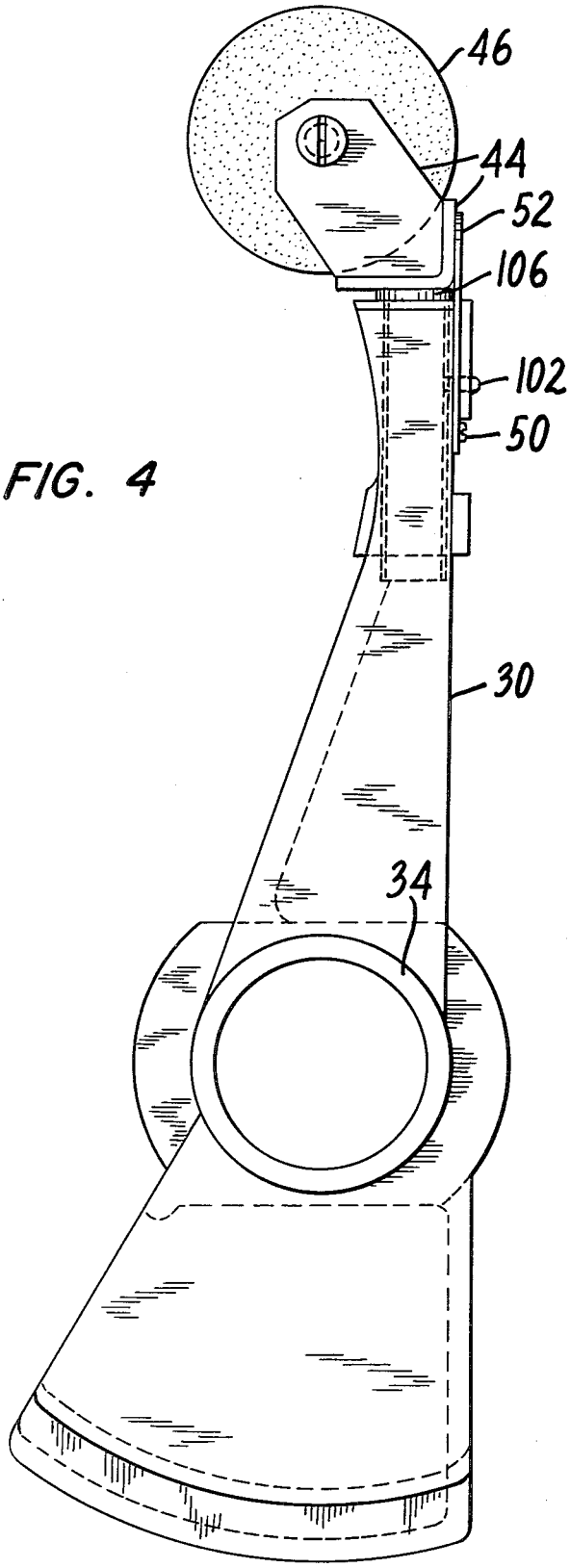
FIG. 4 is a side elevational view of FIG. 3.
Figure 5A:
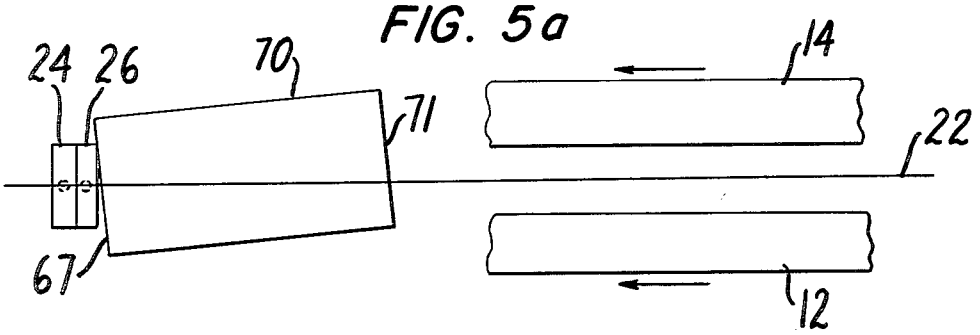
FIGS. 5*a*–5*c* show in diagrammatic plan view successive positions of a carton with skewed end wall panels as it travels along the conveyor and its end wall panels engage the wipe down rollers of the set shown in FIG. 1, the carton being skewed in a counterclockwise sense relative to the carton travel course.
Figure 5B:
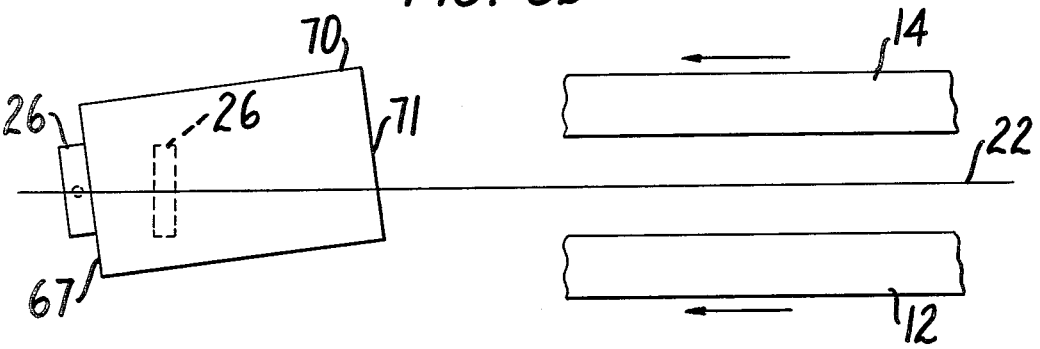
Figure 5C:
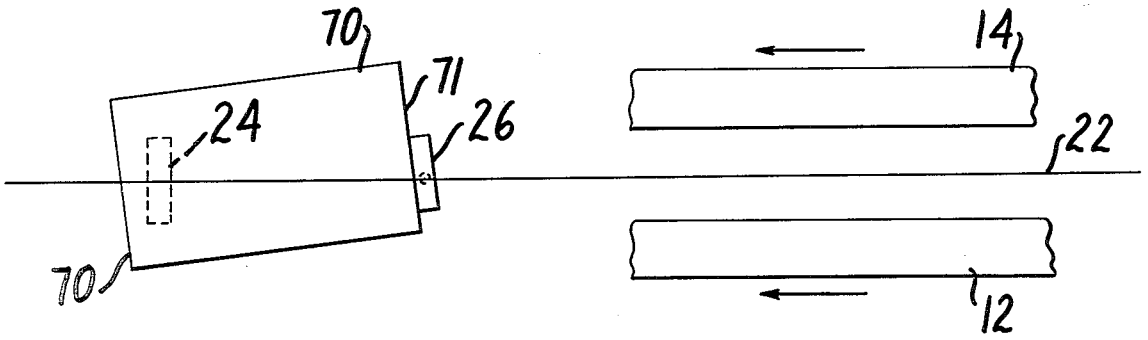

The scissored arms 16, 18 are generally similar in construction and function to those described in the aforementioned U.S. Pat. No. 3,236,716 except as being modified to provide for swivel mounting of the wipe down rollers at the tip ends of such arms. Thus, as seen in FIGS. 3 and 4, the scissored arms each include branch portions 30 and 32 which are provided with hub members 34, such hub members being bored and intended to allow for reception of the arms on the common mounting pivot 20. The right and left branches 32 and 30 are joined near their tops with a integral web member 36 which includes an enlarged central journal structure 38 which is provided with a through passage 40 for reception rotatably therein of a pintle 42 connected to a bracket 44 which in turn rotatably receives the wipe down roller 46. Received on the front side of the web 36 and fixedly secured thereto by means of screws or other fastening means 50, is a blade spring component 52 having right and left blade fingers 54 and 56 which engage the roller bracket on opposite sides of the axis about which pintle 42 rotates and exert biasing force thereon to normally dispose the roller in a position in which its axis of rotation 60 is disposed transversely perpendicular to the travel course 22 of the carton through the apparatus and parallel to the pivot 20 on which hubs 34 are received. The blade spring 52 while exerting bias on the bracket 44 is insufficient to prevent swivelling movement of the roller either clockwise or counterclockwise (when viewed from above the conveyor) under the force of movement of the travelling carton to thereby allow the roller to conformably engage with the skewed end panel of a carton.

As was mentioned before, there are certain circumstances and types of apparatus in which the carton end wall panels can become skewed. Therefore to compensate and allow for the application of substantially uniform pressure by the wipe down rollers against the full lateral expanse of the applied tape, the present invention provides for swivelling of the wipe down roller in correspondence to the skewed disposition of the end panels. Thus with reference to FIGS. *5a–5c*, it will be seen where a skewed front end panel of a carton 70 is approaching the rollers 24, 26, the roller wipe down surface is disposed substantially transversely perpendicular of the travel course 22 of the carton. When the skewed front end panel 67 of the carton 70 engages roller 24, said roller is caused to immediately swivel in a counterclockwise direction and its outer surface is brought into substantially uniform contact along its full length with the carton front end panel and the tape which had been applied thereto so that uniform wipe down pressure is applied across the full lateral expanse of the tape. In FIG. *5b*, it will be noted that the roller 26 is now positioned beneath the bottom panel of the carton 70 and is effecting wipe down action of the tape applied at said bottom panel. As the carton continues its advance leftwardly and as shown in FIG. *5c*, the roller 24 now has moved down below the front end panel 67 and is now applying wiping action to the tape at the bottom side of the carton whereas, the roller 26 has passed up from beneath the carton bottom and into wiping contact against the rear end panel 71 of the carton to apply wiping action to the tape applied at such rear end panel, the roller 26 it being noted, also being in uniformly conformably engaging contact with such skewed rear end panel.

Figure 6:
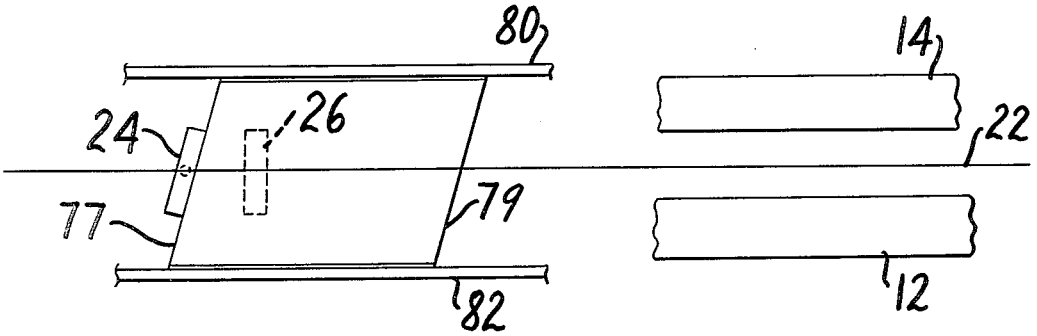
FIG. 6 is a diagrammatic plan depiction of a carton which has had its end wall panels skewed in a clockwise sense by engagement of the carton with clamping guidance side rails which squeeze the carton and distort the carton from its normally square or rectangular profile to a parallelagram having skewed front and rear end panels.

FIG. 6 depicts a situation in which carton clamping guidance side rails 80 and 82 on the tape applying apparatus have squeezed the side walls of the carton such as to distort the end wall panels 77, 79 to transform the normally square or rectangular profile of the carton into a parallelagram in which the front and rear end panels are disposed skewed to the travel course 22 of the carton. However, the rollers 24 and 26 function in the same manner as described in connection with FIGS. *5a–5c* to conformably engage the skewed end panel surfaces, in this instance, the wipe down rollers being caused to rotate clockwise to come into conformable contact engagement with the end panel surface.

The action of the blade spring member 52 can be most readily seen from FIG. 3 of the drawings. When a carton front end panel is skewed as shown in FIGS. *5a–5c*, the left side of the wipe down roller is swivelled in the direction of the viewer and the blade finger 56 tends to resist such swivelling action, the other side of the bracket 44 moving away from the viewer and out of contact with its associated blade finger 54. After the roller has passed under the front end panel, the blade finger 56 functions to return the roller member to its normal position in which it is disposed transversely perpendicular of travel course 22. When the carton front end wall is skewed as shown in FIG. 6, the opposite effect occurs, that is, the right end of the roller assembly swivels in the direction of the viewer causing flexure of the blade finger 54 and the left side of the bracket 44 to move away from the viewer out of contact with the blade finger 56. Again, after the roller has moved down under the front end panel, the blade finger 54 will overcome the swivelled position and return the roller to its normal position.

FIG. 3 also depicts a projection 102 in the form of a pin fixed to the pintle 42 and which projection is received in an elongated opening 104 formed in web center structure 38 so that the extent to which the roller member may be swivelled is limited by engagement of the projection 102 with the opposed lateral slot extremeties. The facility with which the roller can be swivelled is enhanced by utilization of a washer or like member 106 (FIG. 3) and a keeper ring 108 is used to retain the pintle 42 in the bored passage 40.

It will be understood that while the wipe down member has been disclosed herein as being in the form of a roller which preferably is made of rubber and has a release material coating at the outer surface thereof, other forms of wipe down members such as paddles, plates and the like also could be employed provided the same are mounted for swivelling movement in accordance with the teaching of the present invention. Additionally, and in the instance where a rubber roller member is used, the same could be ribbed at its outer surface, that is it could be provided with a series of parallel circularly extending grooves in conventional manner.

It will be appreciated that the travel course 22 of the carton through the apparatus lies in a vertical plane and that the axis about which the pintle 42 rotates may instantaneously change as the arms 16, 18 rotate, such pintle axis nonetheless always lies in said vertical plane.

While there is above disclosed but one embodiment of the swivelled wipe down roller member of the present invention, it will be apparent that various modifications can be made therein without departing from the scope of the inventive concept herein disclosed.

What is claimed is:

1. In apparatus for applying tape to the end wall panels and the top and bottom panels of a carton and including a conveyor unit on which the carton is received and which is operable to convey said carton along a fixed longitudinal travel course with the end wall panels of the carton normally disposed transversely perpendicular to said fixed travel course, and a wipe down device for wiping down tape applied to said carton, said device including an arm rotatable about a fixed axis transverse perpendicular to said travel course, and a tape wipe down member fixed at the end of said arm and disposed generally transversely to said fixed course, said arm being movable such as to position said wipe down member in wipe down engagement with a carton end wall panel as said carton is conveyed along said travel course, the improvement wherein, said wipe down member is rotatably mounted to the end of said arm thereby allowing said wipe down member to swivel for maintaining it in comformable wipe down engagement with a carton end wall panel which is skewed relative to said fixed course in a positioning other than transverse perpendicular therewith, and bias means carried on said arm and engaging with said wipe down member tending to maintain said wipe down member disposed transverse perpendicular to said fixed course.

2. The apparatus of claim 1 in which said bias means comprises a blade spring having spaced apart blade fingers disposed to engage said wipe down member at opposite sides of the axis about which said wipe down member is rotatable.

3. The apparatus of claim 1 in which the tip end of said arm is provided with a bore passage, said wipe down member including a pintle received in said passage.

4. The apparatus of claim 3 further comprising a lateral projection carried on said pintle, said arm having a slotted opening in which said projection is received, engagement of said projection with said arm at opposed locations in said slotted opening limiting the extent to which said wipe down member can swivel.

5. The apparatus of claim 3 in which said wipe down member includes a roller rotatably carried in a mounting bracket, said mounting bracket being fixed to said pintle.

* * * * *